US008097142B2

(12) United States Patent
Willit et al.

(10) Patent No.: US 8,097,142 B2
(45) Date of Patent: Jan. 17, 2012

(54) HIGH-THROUGHPUT ELECTROREFINER FOR RECOVERY OF U AND U/TRU PRODUCT FROM SPENT FUEL

(75) Inventors: James L. Willit, Batavia, IL (US); Mark A. Williamson, Naperville, IL (US)

(73) Assignee: Uchicago Argonne, LLC., Chicago, IL (US)

( * ) Notice: Subject to any disclaimer, the term of this patent is extended or adjusted under 35 U.S.C. 154(b) by 527 days.

(21) Appl. No.: 12/395,777

(22) Filed: Mar. 2, 2009

(65) Prior Publication Data

US 2011/0180409 A1 Jul. 28, 2011

Related U.S. Application Data

(60) Provisional application No. 61/067,568, filed on Feb. 29, 2008.

(51) Int. Cl.
*C25D 3/66* (2006.01)
*C25D 5/00* (2006.01)

(52) U.S. Cl. ..... 205/47; 205/43; 205/44

(58) Field of Classification Search ..... 205/43, 205/44, 47

See application file for complete search history.

(56) References Cited

U.S. PATENT DOCUMENTS

| | | | | |
|---|---|---|---|---|
| 4,297,174 | A * | 10/1981 | Brambilla et al. | 205/44 |
| 4,338,215 | A * | 7/1982 | Shaffer et al. | 588/15 |
| 4,880,506 | A * | 11/1989 | Ackerman et al. | 205/44 |
| 5,531,868 | A * | 7/1996 | Miller et al. | 205/44 |
| 6,540,902 | B1 | 4/2003 | Redey et al. | |
| 6,911,134 | B2 | 6/2005 | Dees et al. | |
| 6,911,135 | B1 * | 6/2005 | Thied et al. | 205/44 |
| 7,011,736 | B1 | 3/2006 | Miller et al. | |
| 7,799,185 | B1 * | 9/2010 | Willit | 204/243.1 |
| 2007/0158196 | A1 | 7/2007 | Kang et al. | |

* cited by examiner

*Primary Examiner* — Alexa Neckel
*Assistant Examiner* — William Leader
(74) *Attorney, Agent, or Firm* — Olson & Cepuritis, Ltd.

(57) ABSTRACT

The present invention provides a method of simultaneously removing uranium and transuranics from metallic nuclear fuel in an electrorefiner. In the method, a potential difference is established between an anode basket containing the fuel and a solid cathode of the electrorefiner, thereby creating a diffusion layer of uranium and transuranic ions at the solid cathode, a first current density at the anode basket, and a second current density at the solid cathode. The ratio of anode basket area to solid cathode area is selected based on the total concentration of uranium and transuranic metals in a molten halide electrolyte in the electrorefiner and the effective thickness of the diffusion layer at the solid cathode, such that the established first and second current densities result in both codeposition of uranium and transuranic metals on the solid cathode and oxidation of the metallic nuclear fuel in the anode basket.

19 Claims, 1 Drawing Sheet

HIGH-THROUGHPUT ELECTROREFINER FOR RECOVERY OF U AND U/TRU PRODUCT FROM SPENT FUEL

CROSS-REFERENCE TO RELATED APPLICATIONS

This application claims the benefit of U.S. Provisional Application Ser. No. 61/067,568, filed on Feb. 29, 2008, which is incorporated herein by reference.

CONTRACTUAL ORIGIN OF THE INVENTION

The United States Government has rights in this invention pursuant to Contract No. W-31-109-ENG-38 between the United States Government and The University of Chicago and/or pursuant to Contract No. DE-AC02-06CH11357 between the United States Government and UChicago Argonne, LLC representing Argonne National Laboratory.

FIELD OF THE INVENTION

This invention relates to the codeposition of U and Pu in an eletrorefiner from metallic nuclear fuel to prevent segregation of weapons-grade Pu.

BACKGROUND OF THE INVENTION

Since the early 1980's in the Integral Fast Reactor (IFR) program the Chemical Engineering Division (Chemical Technology Division at that time) at Argonne National Laboratory (ANL) has been developing molten salt electrorefining as a compact process for recovery of uranium from spent metallic reactor fuel, as well as from Light Water Reactor (LWR) oxide fuel that had been reduced to a metal. In the IFR program uranium and transuranic metals (transuranics, or TRUs) were codeposited in a liquid cadmium cathode. The codeposition or co-recovery of uranium and transuranics was desirable for non-proliferation reasons.

SUMMARY OF THE INVENTION

The electrorefiner technology has gone through several developmental iterations. The most recent electrorefiner design is called the Planar Electrode ElectroRefiner (PEER). A prototype module has been tested successfully in the Chemical Sciences and Engineering Division at ANL and has met every expectation with respect to the high efficiency cathode scraping and scalability of the design.

In addition to the planar anode baskets and intermittently scraped cathode rods, the PEER design also allows for simple removal of the electrorefined uranium product by collection of the scraped cathode deposit in a basket that is periodically removed from the unit, emptied, and then replaced. Direct removal of the electrorefined product allows the PEER to be passing current, and thus refining the material nearly 100% of the time.

This is a distinct advantage over the Mk-V high throughput electrorefiner that was developed by ANL, and is presently being used to treat EBR-II blanket fuel at Idaho National Laboratory (INL). In the Mk-V electrorefiner, the cathode deposit is not efficiently scraped off and the product falls to a product collector that is attached to the mk-V anode-cathode-module (ACM). To recover the electrorefined uranium product, the entire unit must be removed and the product collector replaced. In a hot cell using remote handling, this process takes up to 12 hours to complete.

Codeposition of U and TRU's at a Solid Cathode in the PEER Design.

In the electrorefining of spent reactor fuel, the actinides, TRU's and active metal fission products are oxidized at the anode and dissolve in the molten salt electrolyte as metal cations. Under normal operating conditions, only uranium is deposited on the cathode. However, if the cathode potential can be made sufficiently negative, uranium and TRUs will codeposit on the cathode. The key to obtaining a sufficiently negative cathode potential is a high cathode current density that depletes uranium from the molten salt electrolyte near the cathode surface. In a practical sense, for this to occur in a uranium electrorefiner in which the electrolyte is molten LiCl-KCl, the anode area must greatly exceed the cathode area. The necessary difference in anode vs. cathode areas is needed because the limiting current density for uranium oxidation at the anode is surprisingly low at potentials that will not oxidize the structural steel in the anode basket. Achieving a sufficiently high anode-to-cathode surface area makes it possible to codeposit U and TRUs on a solid cathode. The PEER design uses multiple planar anode baskets with interleaved linear cathode arrays between the baskets. By disconnecting the linear cathode arrays and adding an additional cathode rod to the side of the anode baskets necessary anode-to-cathode area ratio can be achieved. The U/TRU deposit can be intermittently scraped off the cathode and removed in the same manner as the uranium deposit is scraped off and removed as described previously.

The methods of the present invention have several advantages over existing processes that employ a liquid cadmium or bismuth cathode. First, this invention eliminates the use of cadmium and the engineering challenges of operating a liquid metal cathode. Second, this invention achieves a greater degree of separation between TRUs and rare earths than can ever be achieved with a liquid cadmium cathode. This invention also has a strong nuclear proliferation-resistance aspect, in that as long as the material used in the anode basket is spent fuel that contains a significant fraction of uranium, it is impossible to obtain a pure plutonium (or uranium-free TRU) product at the cathode, because uranium will always be present in the system and codeposit with the TRUs.

Accordingly, the present invention provides a method of simultaneously removing uranium and transuranics from metallic nuclear fuel containing both uranium and transuranics in an electrorefiner having a solid cathode and an anode basket containing the metallic nuclear fuel and a molten halide electrolyte. The process comprises (a) establishing a potential difference between the anode basket and solid cathode, thereby creating a diffusion layer of uranium and transuranic ions at the solid cathode, a first current density at the anode basket, and a second current density at the solid cathode; (b) establishing a ratio of anode basket area to solid cathode area dependent on the total concentration of uranium and transuranics in the molten halide electrolyte and the effective thickness of the diffusion layer at the solid cathode, such that the established first and second current densities result in both codeposition of uranium and transuranics on the solid cathode and oxidation of the metallic nuclear fuel in the anode basket; (c) maintaining the first and second current densities at levels sufficient to codeposit uranium and transuranics on the solid cathode; (d) removing deposited material from the solid cathode; and (e) controlling the first current density at the anode basket to prevent substantial oxidation of the anode basket during operation of the electrorefiner.

The present invention also provides a method of simultaneously removing uranium and transuranics from metallic nuclear fuel containing both uranium and transuranics in an electrorefiner having a solid cathode and an anode basket containing the metallic nuclear fuel and a molten halide electrolyte. In this aspect, the process comprises (a) establishing a potential difference between the anode basket and solid cathode, thereby creating a diffusion layer of uranium and transuranic ions at the solid cathode, a first current density at the anode basket, and a second current density at the solid cathode; (b) establishing a ratio of anode basket area to solid cathode area dependent on the total concentration of uranium and transuranics in the molten halide electrolyte and the effective thickness of the diffusion layer at the solid cathode, such that the first current density is maintained in the range of about 70 mA/cm$^2$ to about 100 mA/cm$^2$, and the second current density at the solid cathode is maintained in the range of greater than about 200 to about 1400 mA/cm$^2$, resulting in both codeposition of uranium and transuranics on the solid cathode and oxidation of the metallic nuclear fuel in the anode basket; (c) maintaining the first and second current densities at levels to codeposit uranium and transuranics on the solid cathode; (d) removing deposited material from the solid cathode; and (e) controlling the first current density at the anode basket to prevent substantial oxidation of the anode basket during operation of the electrorefiner.

In addition, the present invention provides a method of simultaneously removing uranium and transuranics from metallic nuclear fuel containing both uranium and transuranics in an electrorefiner having a solid cathode and a plurality of electrically connected anode baskets containing the metallic nuclear fuel and a molten halide electrolyte, the anode baskets including opposed planar meshes establishing contact between the metallic nuclear fuel and the molten electrolyte. In this aspect, the process comprises (a) establishing a potential difference between the anode baskets and solid cathode, thereby creating a diffusion layer of uranium and transuranic ions at the solid cathode, a first current density at the anode baskets, and a second current density at the solid cathode; (b) establishing a ratio of total anode basket area to solid cathode area dependent on the total concentration of uranium and transuranics in the molten halide electrolyte and the effective thickness of the diffusion layer at the solid cathode such that the established first and second current densities result in both codeposition of uranium and transuranics on the solid cathode and oxidation of the metallic nuclear fuel in the anode baskets; (c) maintaining the first and second current densities at levels to codeposit uranium and transuranics on the solid cathode; (d) removing deposited material from the solid cathode; and (e) controlling the first current density at the anode baskets to prevent substantial oxidation of the anode baskets during operation of the electrorefiner.

The invention includes of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
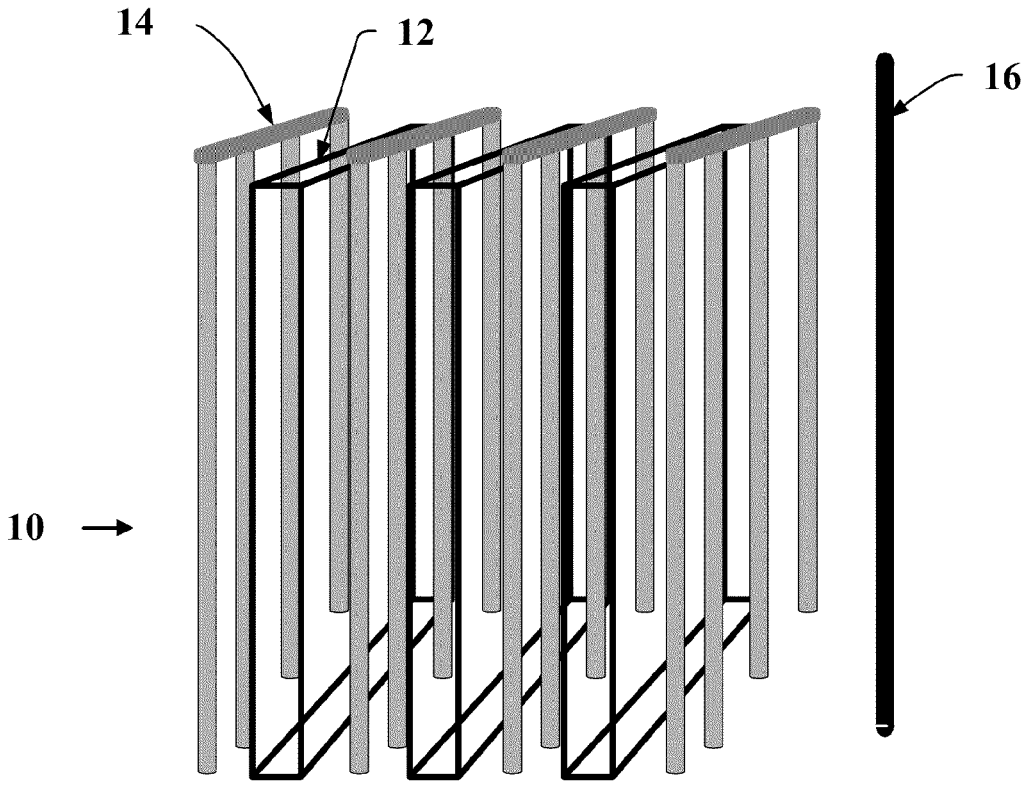
FIG. 1 is a schematic representation of an electrode arrangement in a planar electrode electrorefiner for deposition of high purity uranium and codeposition of uranium-transuranic mixture.

A basic electrolytic cell consists of an anode and a cathode immersed in an electrolyte. The cell is typically operated under controlled current or controlled voltage conditions. When a voltage is applied between the two electrodes (controlled potential mode) or an electric current is passed between the electrodes (controlled current mode) two electrochemical reactions occur simultaneously, namely an oxidation reaction at the anode and a reduction reaction at the cathode. Electrorefining is one type of electrolytic process. In an electrorefining cell an impure metal is electrochemically oxidized at the anode and high-purity metal is electrochemically reduced and deposited at a cathode. The anode and cathode reactions are shown below in Equations 1 and 2 respectively. For the specific case of electrorefining a metal R, which represents the reduced species, is in the metallic state and O, which represents the oxidized species, is a metal cation.

$$R \rightarrow ne^- + O^{n+} \text{ anode reaction} \quad (1)$$

$$O^{n+} + ne^- \rightarrow R \text{ cathode reaction} \quad (2)$$

Most industrial electrolytic processes are operated under controlled current conditions. In this mode of operation, the electrode potentials are controlled by mass transport. At steady state conditions a concentration gradient forms near the anode and cathode surfaces. The region where this concentration gradient occurs is called the diffusion layer. In the limiting case the concentration of the oxidized species at the anode surface is the concentration of the pure oxidized species in units of mol/cm$^3$. The concentration of the oxidized species in the bulk electrolyte ranges from zero to the saturation concentration of the oxidized species in the electrolyte. This concentration gradient typically occurs over a short distance (about $10^{-2}$ cm). Based on this simple concentration gradient model, the mass-transport limited current $i_{lim}$ can be calculated using Equation 3.

$$i_{lim} = nFA\Delta CD/\delta \quad (3)$$

In Equation 3, n is the number of electrons transferred and has the same value as in Equations 1 and 2, F is Faraday's constant (96485 coulombs/equivalent), A is the electrode area in cm$^2$, $\Delta C$ is the change (mol/cm$^3$) in concentration of the oxidized species (O) in the diffusion layer, D is the diffusion coefficient (cm$^2$/sec), and $\delta$ is the thickness of the diffusion layer in cm. The term $D/\delta$ can be combined to give a "velocity" term, v which has units of cm/sec as shown in Equation 4.

$$i_{lim} = nFA\Delta Cv \quad (4)$$

This invention specifically addresses electrorefining in a molten chloride electrolyte, a metal alloy containing uranium, transuranics, less "active" metals (e.g. iron, zirconium, molybdenum, rhodium), and active metal fission products (e.g. cesium, strontium, barium, and rare earth metals). Such an alloy arises from spent metallic nuclear reactor fuel or spent oxide nuclear reactor fuel that has been reduced to a metallic state. Numerous experiments at small and large scales have demonstrated that the limiting current per unit area for oxidation of uranium metal in a molten chloride electrolyte is about 0.1 A/cm$^2$. The maximum value for $\Delta C$ at a uranium anode undergoing oxidation can be approximated by the concentration of pure $UCl_3$ (about $1.5\times10^{-2}$ mol/cm$^3$). Inserting these values along with a n value of 3 into Equation 4 affords a $v_{ox}$ value of $2.3\times10^{-5}$ cm/sec for electrochemical oxidation of uranium in a molten chloride salt. The electrochemical reduction of $UCl_3$ to U metal at a cathode has also been well-studied. Experimental measurements of D and δ for electrodeposition of uranium at a cathode in a molten chloride salt have established a $v_{red}$ value of $2\times10^{-3}$ cm/sec for reduction of $UCl_3$ to U-metal at a cathode in a molten chloride salt. It is reasonable to assume the $v_{red}$ values for transuranic chlorides such as $PuCl_3$, $AmCl_3$, and $NpCl_3$ would be comparable to that for $UCl_3$.

Equations 5 and 6 describe the condition when both electrodes are operating at their maximum, mass-transport-limited current. When both electrodes are at the mass-transport limited current, the anode and cathode are polarized to the same degree.

$$i_{lim,\,cathode}=i_{lim,\,anode} \tag{5}$$

$$n\cdot F\cdot A_{cathode}\cdot\Delta C_{cathode}\cdot v_{red}=n\cdot F\cdot A_{anode}\cdot\Delta C_{anode}\cdot v_{ox} \tag{6}$$

If the concentration of the oxidized species in the molten salt electrolyte is small (i.e. <10 wt %) the limiting value of $\Delta C_{anode}$ is about $1.5\times10^{-2}$ mol/cm$^2$ as stated above. Similarly, in the limiting case, when the concentration of the oxidized species at the cathode/electrolyte interface is zero, $\Delta C_{cathode}$ is simply the concentration of the oxidized species in the bulk electrolyte $C_{ox}$. Making these substitutions into Equation 6 as well, along with an algebraic manipulation provides Equation 7, which shows the relationship between the ratio of the anode and cathode areas to the concentration and velocity terms.

$$A_{anode}/A_{cathode}=(C_{ox}\cdot v_{red})/(v_{ox}\cdot 1.5\times10^{-2}\ \text{mol/cm}^3) \tag{7}$$

Using the experimentally determined values for $v_{ox}$ and $V_{red}$ for uranium electrorefining derived above, Equation 7 simplifies to Equation 8 in which the $A_{anode}$ to $A_{cathode}$ ratio in the case where both electrodes are operating at their respective mass-transport limits where $C_{ox}$ is the concentration of the oxidized species in the bulk electrolyte.

$$A_{anode}/A_{cathode}=(C_{ox}\cdot 6\times10^3\ \text{cm}^3/\text{mol}) \tag{8}$$

This derivation illustrates that at $A_{anode}/A_{cathode}$ ratios larger than the value calculated using Equation 8, the electrorefining cell will operate at the mass transport limit only at the cathode and the cathode will be polarized to a greater degree than the anode. Conversely operation of the cell at $A_{anode}/A_{cathode}$ ratios smaller than the value calculated using Equation 8 results in mass-transport limited conditions occurring only at the anode and the anode will be polarized to a greater degree than the cathode.

This invention has significant implications for the design of electrorefiners for treating spent nuclear fuel. If the cell is operated at currents that exceed the limiting current for oxidation of uranium, the potential at the anode will shift to increasingly positive values until oxidation of a more noble metal such as iron can occur to supply the necessary current or a potential that oxidizes $U^{+3}$ to $U^{+4}$. Because uranium electrorefiners typically use steel anode baskets and the anode feed material can include steel or zircaloy cladding, anode potentials that result in the oxidation of iron or zirconium are usually not desirable. Oxidation of $U^{+3}$ to $U^{+4}$ decreases the current efficiency of the process because it creates a parasitic redox reaction as $U^{+4}$ is reduced back to $U^{+3}$ at the cathode. Just as multiple anode oxidations can occur at the anode, depending on the cell current and resulting anode potential, multiple reduction reactions can likewise occur at the cathode. If the cathode current exceeds the limiting current for reduction of $UCl_3$ and the electrolyte contains other, more stable metal chloride species such as $PuCl_3$, $AmCl_3$, $NpCl_3$, or rare earth chlorides, the cathode potential will shift to more negative values where reduction of these other species occur. This results in the codeposition of uranium and transuranics at a solid cathode at sufficiently high values of the ratio $A_{anode}/A_{cathode}$. For the case where uranium and transuranics codeposit, the effective value for $C_{ox}$ is approximated as the sum of the $UCl_3$ and transuranic chlorides concentrations in the electrolyte. To ensure that the cathode potential does not shift too negative, a reference electrode may be used to measure the cathode potential versus the reference electrode.

By adjusting the relative electrode areas and the composition of the electrolyte and thereby the relative degree of anode and cathode polarization, it is possible to operate an electrorefiner for spent reactor fuel to obtain a high purity uranium product or a mixed uranium-transuranic product. Allowing for some error in the values of $v_{ox}$ and $v_{red}$, and converting the concentrations ($C_{ox}$) from mol/cm$^3$ to weight percent ($C_{ox,\ wt\ \%}$) the following guiding calculations (Equations 9 and 10) can be used to ensure that the electrorefiner is operating in a cathode or anode limited mode. Experiments in which the degree of anode and cathode polarization were measured over a range of $A_{anode}/A_{cathode}$ demonstrated behavior that is consistent with Equation 8.

$$\text{Anode Limited Mode } A_{anode}/A_{cathode}\leqq(C_{ox,\ wt\ \%}\cdot 0.1\ \text{wt}\ \%^{-1})\ \text{(pure uranium cathode deposit)} \tag{9}$$

$$\text{Cathode Limited Mode } A_{anode}/A_{cathode}\geqq(C_{ox,\ wt\ \%}\cdot 10\ \text{wt}\ \%^{-1})\ \text{(uranium-transuranic codeposit)} \tag{10}$$

Typical uranium concentrations in this field range from 1 to 7 wt % and combined uranium+transuranic concentration in this work range from 2 to 8 wt %. Inserting these typical concentration ranges in Equations 9 and 10 results in an anode:cathode area ratio ranging from less than 0.1 (1 wt % uranium) to less than 0.7 (7 wt % uranium) to ensure a pure uranium cathode deposit. As electrorefining progresses the anode:cathode ratio will become smaller as the anode area decreases and the cathode area increases. In the case where deposition of high-purity uranium is desirable a low initial anode:cathode ratio will be used and the ratio will further decrease as the anode is consumed. This means that conditions favoring deposition of high-purity uranium will prevail throughout the process operation.

Similarly, an anode-cathode area ratio ranging from greater than 70 (7 wt % uranium in electrolyte) to at least about 10 (1 wt % uranium in the electrolyte) will make it possible to achieve cathode potentials at which uranium and transuranics will codeposit. This analysis suggests that the anode:cathode ratios at lower concentrations (i.e. 1-3 wt % uranium) are more practical.

The anode:cathode area ratio specifications described above can also be recast in terms of anode and cathode current densities. As stated above, at an anode current density of 70 to 100 mA/cm$^2$, only the spent metallic fuel and not the cladding and steel basket hardware will be oxidized because the anode potential is not sufficiently anodically polarized for oxidation of iron. This limiting current density is essentially independent of the typical range of $UCl_3$ or transuranic chloride concentrations in the molten salt electrolyte. Consequently, a plot of anode current density vs. anode polarization should show no dependence on concentration of $UCl_3$ in the electrolyte. This has been observed experimentally. Also as stated above the cathode current density must be sufficiently large to require the reduction of transuranic chlorides in addition to the reduction of uranium chlorides and thus shift the cathode potential to more negative values. This cathode limiting current density for uranium and transuranic codeposition is dependent on the combined concentration of uranium and transuranic chlorides dissolved in the molten salt electrolyte. Thus, unlike the case for the anode, a plot of cathode current density vs. cathode polarization will have an increasing slope with increasing values for $C_{ox}$. Therefore Equation 11 can be written to describe the relationship between the combined concentration of uranium and transuranic chlorides ($C_{ox,\,wt\,\%}$) in the molten salt electrolyte and the limiting current density at the cathode, $j_{lim,cathode}$. The 200 mA/(cm$^2$·wt %) coefficient of Equation 11 includes a roughness factor and an allowance for the increase in cathode surface area as the cathode deposit grows. Therefore, the to $A_{cathode}$ term in Equation 11 is the geometric area of the cathode.

$$j_{lim,cathode}=i_{lim,cathode}/A_{cathode}>[200\ \text{mA}/(\text{cm}^2\cdot\text{wt}\ \%)]\cdot C_{oc,\,wt\,\%} \quad (11)$$

As stated above, typical values for $C_{ox,\,wt\,\%}$ range from 1 to 7 wt %. Using these values in Equation and allowing for surface roughness and a growing surface area, uranium and transuranics will codeposit at a metal cathode under typical conditions at current densities ranging from greater than 200 and 1400 mA/cm$^2$, respectively.

The ability to achieve codeposition of uranium and transuranics at a solid cathode is both a surprising and significant achievement for the pyrochemical treatment of spent reactor fuel. Prior to this invention, codeposition of uranium and transuranics was thought to require a large (i.e., >30) PuU concentration ratio in the molten salt electrolyte or the use of a liquid metal cathode that shifted the reduction potential of the transuranic chlorides to more positive values. In fact it has been demonstrated many times that the use of liquid cadmium or bismuth cathodes does allow for codeposition of uranium and transuranics. However, these liquid metal cathodes also shift the deposition potential for rare earth chlorides to more positive potentials as well. Unfortunately, at the liquid cadmium cathode, the potential shift to less cathodic potentials for the rare earth chloride deposition is typically larger than the cathodic shift in transuranic deposition potential. This larger shift in rare earth chloride deposition potential decreases the degree of separation that can be achieved between the transuranics and the rare earths. If the uranium and transuranics are to be recycled into fresh fuel, rare earth contamination is not desirable. A much greater degree of separation between the transuranics and the rare earths can be achieved using a solid cathode. In fact comparing transuranic-rare earth separation factors for a solid cathode and a liquid cadmium cathode shows that compared to a liquid cadmium cathode, the transuranic-rare earth separation factors are 100,000 times larger even at low PuU concentration ratios in the molten salt. This huge increase in transuranic-rare earth separation factor means that the uranium-transuranic codeposit can be recycled into fresh fuel, and meet the low-rare-earth content specifications for the new nuclear fuel.

For illustration purposes only, not to be construed as limiting, an electrorefiner 10 such as schematically illustrated in FIG. 1, which can be used for deposition of pure uranium or co-deposition of uranium and transuranic metals, as desired. Electrorefiner 10 consists of one or more planar anode baskets 12 equally spaced in a parallel arrangement with a linear array of cathode rods 14 interleaved with the anode baskets 12, as well as an optional single, small-area cathode 16. The anode baskets 12 are loaded with spent metallic nuclear fuel or spent oxide nuclear fuel that has been reduced to a metallic state, containing uranium and transuranic metals. The anode baskets 12 are electrically connected in parallel to the positive terminal of a power supply (not shown). The array of cathode rods 14 likewise can be connected in parallel to the negative terminal of the power supply. The relative anode-to-cathode area ratios of these anode baskets 12 and array of cathode rods 14 meet the criteria of Equation 9. Passing current between these anodes with a voltage limit of 0.8 volts (0.45 volts if zircaloy clad or zirconium metal is present in the anode basket) results in deposition of substantially pure uranium (typically a dendritic deposit) on array 14. These potential limits are used to prevent oxidation of iron or zirconium at the anode. To ensure that undesired oxidation reactions do not occur at the anode, the anode potential versus a stable reference electrode is monitored. The cathode rods 14 are periodically scraped by lowering a die-assembly (not shown in FIG. 1) down the length of cathode rods 14. The dislodged cathode product is caught directed to a collection basket (not shown in FIG. 1) positioned beneath the cathode rods. The collection basket can then be moved to a position outboard of the electrodes and removed from the process vessel. After the uranium electrodeposit is removed from the collection basket the collection basket can be re-inserted in the vessel and repositioned to catch the subsequent scraped uranium electrodeposit.

Periodically a smaller surface area cathode 16 can be inserted into the electrorefiner or some of the cathode rod assemblies 14 can be switched out of the circuit, such that an anode-to-cathode area ratio that satisfies Equation 10 is reached. Passing current between the full set of anode baskets and this smaller-area cathode results in codeposition of uranium and transuranics on cathode 16. Alternatively, a second power supply circuit with the anode baskets 12 connected to the positive terminal of the power supply and the small-surface-area cathode 16 connected to the negative terminal of the power supply and using both power supplies to simultaneously deposit uranium on the multiple cathode arrays 14 and codeposit uranium and transuranics on the small-surface-area cathode 16.

The electrode arrangement shown in FIG. 1 is well-suited for commercial-scale applications because it is readily scalable and has the advantage of a common anode and cathode design however other geometrical arrangements of anodes and cathodes are available that conform to the area ratios described in Equations 9 and 10.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The embodiments of the invention in which an exclusive property or privilege is claimed are defined as follows:

1. A method of simultaneously removing uranium and transuranic metals from metallic nuclear fuel containing both uranium and transuranic metals in an electrorefiner comprising a solid cathode and an anode basket containing the metallic nuclear fuel and a molten halide electrolyte; the method comprising:

establishing a potential difference between the anode basket and solid cathode, thereby creating a diffusion layer of uranium and transuranic ions at the solid cathode, a first current density at the anode basket, and a second current density at the solid cathode;

establishing a ratio of anode basket area to solid cathode area dependent on the total concentration of uranium and transuranic metals in the molten halide electrolyte and the effective thickness of the diffusion layer at the solid cathode, such that the established first and second current densities result in both codeposition of uranium and transuranic metals on the solid cathode and oxidation of the metallic nuclear fuel in the anode basket;

maintaining the first and second current densities at levels sufficient to codeposit uranium and transuranic metals on the solid cathode;

removing deposited material from the solid cathode; and controlling the first current density at the anode basket to prevent substantial oxidation of the anode basket during operation of the electrorefiner.

2. The method of claim 1, wherein the solid cathode includes one or more metals selected from the group consisting of Fe, W, Mo, and an alloy of two or more of the foregoing metals.

3. The method of claim 1, wherein the solid cathode comprises W, Mo, or an alloy thereof.

4. The method of claim 1, wherein the electrolyte comprises LiCl, KCl or a combination thereof.

5. The method of claim 4, the electrolyte is a eutectic mixture of LiCl and KCl.

6. The method of claim 1, wherein the anode basket comprises stainless steel, and the first current density at the anode basket is less than about 100 mA/cm$^2$.

7. The method of claim 1, wherein the first current density at the anode basket is maintained in the range of about 70 mA/cm$^2$ to about 100 mA/cm$^2$.

8. The method of claim 1, wherein the second current density at the solid cathode is greater than about 200 mA/cm$^2$.

9. The method of claim 1, wherein the second current density at the solid cathode is maintained in the range of about 200 mA/cm$^2$ to about 1600 mA/cm$^2$.

10. The method of claim 1, wherein the ratio of the anode basket area to the cathode area is at least about 10:1.

11. The method of claim 1, wherein the ratio of anode basket area to cathode area is in the range of about 10:1 to about 70:1.

12. A method of simultaneously removing uranium and transuranic metals from metallic nuclear fuel containing both uranium and transuranic metals in an electrorefiner comprising a solid cathode and an anode basket containing the metallic nuclear fuel and a molten halide electrolyte; the method comprising:

establishing a potential difference between the anode basket and solid cathode, thereby creating a diffusion layer of uranium and transuranic ions at the solid cathode, a first current density at the anode basket, and a second current density at the solid cathode;

establishing a ratio of anode basket area to solid cathode area dependent on the total concentration of uranium and transuranic metals in the molten halide electrolyte and the effective thickness of the diffusion layer at the solid cathode, such that the first current density is maintained in the range of about 70 mA/cm$^2$ to about 100 mA/cm$^2$ and the second current density is maintained at the solid cathode in the range of about 200 mA/cm$^2$ to about 1400 mA/cm$^2$, resulting in both codeposition of uranium and transuranic metals on the solid cathode, and oxidation of the metallic nuclear fuel in the anode basket;

maintaining the first and second current densities at levels sufficient to codeposit uranium and transuranic metals on the solid cathode;

removing deposited material from the solid cathode; and controlling the first current density at the anode basket to prevent substantial oxidation of the anode basket during operation of the electrorefiner.

13. The method of claim 12, wherein the solid cathode includes one or more of metals selected from the group consisting of Fe, W, Mo, and an alloy of two or more of the foregoing metals.

14. The method of claim 12, wherein the solid cathode comprises W, Mo, or an alloy thereof.

15. The method of claim 12, wherein the electrolyte comprises LiCl, KCl, or a combination thereof.

16. The method of claim 15, the electrolyte is a eutectic mixture of LiCl and KCl.

17. The method of claim 12, wherein the ratio of the anode basket area to the cathode area is at least about 10:1.

18. The method of claim 12, wherein the ratio of anode basket area to cathode area is in the range of from about 10:1 to about 70:1.

19. A method of simultaneously removing uranium and transuranic metals from metallic nuclear fuel containing both uranium and transuranic metals in an electrorefiner comprising a solid cathode and a plurality of electrically connected anode baskets containing the metallic nuclear fuel and a molten halide electrolyte; the anode baskets including opposed planar meshes establishing contact between the metallic nuclear fuel and the molten electrolyte; the method comprising:

establishing a potential difference between the anode baskets and solid cathode, thereby creating a diffusion layer of uranium and transuranic ions at the solid cathode, a first current density at the anode baskets, and a second current density at the solid cathode;

establishing a ratio of total anode basket area to solid cathode area dependent on the total concentration of uranium and transuranic metals in the molten halide electrolyte and the effective thickness of the diffusion layer at the solid cathode, such that the established first and second current densities result in both codeposition of uranium and transuranic metals on the solid cathode, and oxidation of the metallic nuclear fuel in the anode baskets;

maintaining the first and second current densities at levels sufficient to codeposit uranium and transuranic metals on the solid cathode;

removing deposited material from the solid cathode; and controlling the first current density at the anode baskets to prevent substantial oxidation of the anode baskets during operation of the electrorefiner.

* * * * *